US007451703B1

(12) United States Patent
Dabiri

(10) Patent No.: US 7,451,703 B1
(45) Date of Patent: Nov. 18, 2008

(54) VENTED LIFTING PLUG FOR MUNITION

(75) Inventor: Shahram Dabiri, Flanders, NJ (US)

(73) Assignee: The United States of America as represented by the Secretary of the Army, Washington, DC (US), .

( * ) Notice: Subject to any disclaimer, the term of this patent is extended or adjusted under 35 U.S.C. 154(b) by 403 days.

(21) Appl. No.: 11/306,264

(22) Filed: Dec. 21, 2005

Related U.S. Application Data

(60) Provisional application No. 60/597,301, filed on Nov. 22, 2005.

(51) Int. Cl.
*F42A 9/00* (2006.01)

(52) U.S. Cl. ..... 102/481; 102/499; 102/365; 102/470; 102/439; 102/200; 89/1.816; 137/74

(58) Field of Classification Search ..... 102/499, 102/481, 365, 470, 439, 200; 89/1.816; 137/74
See application file for complete search history.

(56) References Cited

U.S. PATENT DOCUMENTS 195,367 A * 9/1877 Hiller ..... 122/504.3
3,665,857 A * 5/1972 Radnich et al. ..... 102/481
3,974,774 A * 8/1976 Schaffner et al. ..... 102/365
4,004,516 A * 1/1977 Johnson et al. ..... 102/499
4,423,683 A * 1/1984 Telmo ..... 102/481
4,557,198 A * 12/1985 Hickey ..... 102/481
5,155,298 A * 10/1992 Koontz ..... 102/481
5,611,424 A * 3/1997 Sniezek et al. ..... 206/3
7,025,000 B1 * 4/2006 Wong et al. ..... 102/481
7,107,909 B2 * 9/2006 Haeselich ..... 102/470
7,322,295 B1 * 1/2008 Haeselich ..... 102/470

FOREIGN PATENT DOCUMENTS

EP 1722188 A1 * 11/2006
JP 2000357444 A * 12/2000

* cited by examiner

*Primary Examiner*—Lynda Jasmin
*Assistant Examiner*—Samir Abdosh
(74) *Attorney, Agent, or Firm*—Michael Sachs

(57) ABSTRACT

Apparatus for venting munitions exposed to high ambient temperatures. The munition includes a casing having a nose end and an opening in the nose end; a lifting plug disposed in the opening in the nose end, the lifting plug including a bore therethrough; and a seal disposed in the bore in the lifting plug, the seal comprising an ionomer. The munition may further include a fuze well disposed in the casing, the opening in the nose end leading into the fuze well; and a second seal disposed in the fuze well. The seals will rupture and vent the munition's explosive to the atmosphere.

1 Claim, 1 Drawing Sheet

VENTED LIFTING PLUG FOR MUNITION

CROSS-REFERENCE TO RELATED APPLICATIONS

This application claims benefit under 35 USC 119(e) of provisional application 60/597,301, filed Nov. 22, 2005, the entire file wrapper contents of which provisional application are herein incorporated by reference as though fully set forth at length.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to lifting plugs for munitions.

Because of their weight, most separate-loading projectiles (munitions) include an eyebolt lifting plug. The plug is for lifting; to keep the fuze well clean, dry and free of foreign matter; and to protect the fuze well threads. At the firing location, the plug is removed and the appropriate fuze is inserted.

Insensitive Munitions (IM) requirements relate to safe storage and transportation of munitions. For example, the accidental detonation of one munition should not cause a chain reaction of detonations of adjacent munitions. Also, in case of a fire, the increase in ambient temperature should not cause an explosive detonation. One way to help meet the IM requirements is to provide a vent in the munition. As the explosive in a munition begins to react due to an increase in ambient temperature, the temperature and pressure inside the munition increases. By relieving the pressure in the munition, the speed and violence of the reaction may be controlled.

SUMMARY OF THE INVENTION

It is an object of the invention to provide munitions that are safer to store and transport.

It is another object of the invention to provide a munition with a vent for relieving excess pressure.

A further object of the invention is to provide a munition with a vent that is normally closed but that opens with increased pressure and/or temperature in the munition.

Still another object of the invention is to provide a venting apparatus that may be used with existing munitions.

One aspect of the invention is a munition comprising a casing having a nose end and an opening in the nose end; a lifting plug disposed in the opening in the nose end, the lifting plug including a bore therethrough; and a seal disposed in the bore in the lifting plug, the seal comprising an ionomer.

The munition may further comprise a fuze well disposed in the casing, the opening in the nose end leading into the fuze well; and a second seal disposed in the fuze well. Preferably, the second seal also comprises an ionomer. In one embodiment, at least one of the seal and the second seal are solid. In another embodiment, at least one of the seal and the second seal has a hollow interior.

The munition may comprise an explosive disposed in the casing wherein, as the explosive is heated, the seal and the second seal will fail before the explosive detonates.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
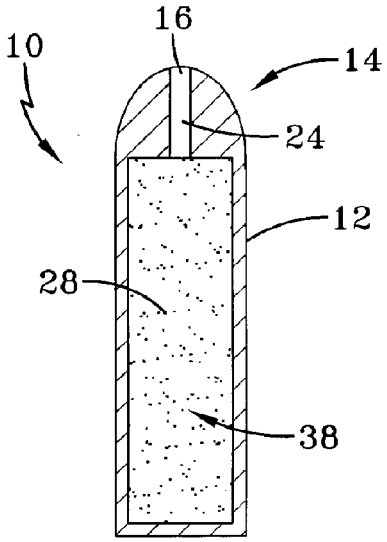
FIG-1 PRIOR ART
FIG. 1 is a section of a munition.

FIG. 1 schematically shows a section of a known munition 10. Munition 10 comprises a casing 12 having a nose end 14 and an opening 16 in the nose end 14. A fuze well 24 is disposed in the casing 12 with the opening 16 in the nose end 14 leading into the fuze well 24. Casing 12 defines an interior volume 38 in which is disposed a payload 28, for example, a high energy explosive. The propellant for the munition 10 is typically separately loaded in the gun tube and is not shown in the figures.

Figure 2:
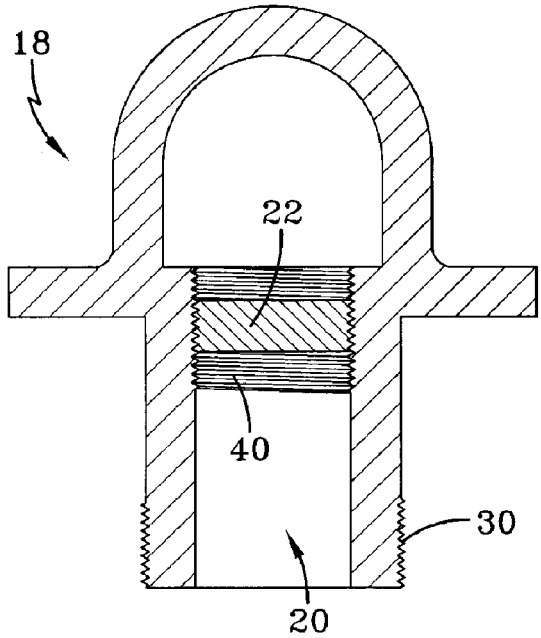
FIG. 2 is a section of a lifting plug.

FIG. 2 is a section of one embodiment of a lifting plug 18 in accordance with the invention. Lifting plug 18 is similar to known lifting plugs except that it includes a bore 20 formed therethrough. Lifting plug 18 may be made of, for example, cast steel. Lifting plug 18 has external threads 30 that mate with internal threads 34 (FIG. 4) in the fuze well 24. A seal 22 is disposed in the bore 20 of the lifting plug 18. Preferably, the seal 20 comprises an ionomer, such as the material sold under the trade name FORMION. When plug 18 is threaded into the fuze well 24, the plug 18 and seal 22 close the fuze well and casing.

Figure 3A:
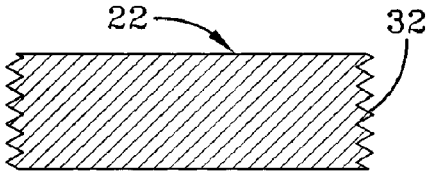
FIGS. 3A and 3B are sectional views of seals.
Figure 3B:
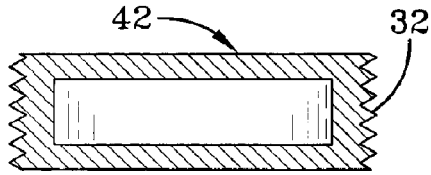

FIGS. 3A and 3B are sectional views of two seals 22 and 42. In FIG. 3A, seal 22 is a solid seal formed of an ionomer and having external threads 32 that mate with the internal threads 40 of the lifting plug 18 or the internal threads 34 (FIG. 4) of the fuze well 24. FIG. 3B shows a seal 42 that is similar to seal 22, except that seal 42 is hollow rather than solid. The hollow seal 42 may be better able to expand and contract throughout the thermal cycle of the munition 10.

Figure 4:
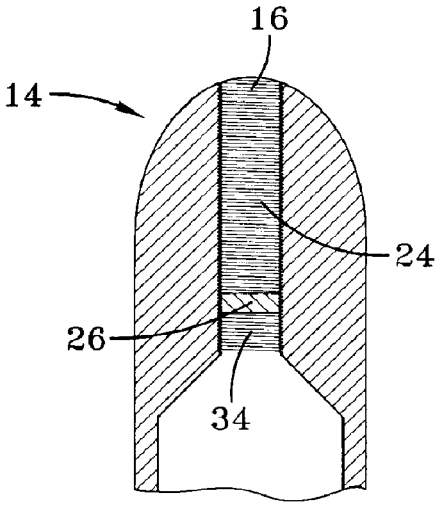
FIG. 4 is a sectional view of the nose portion of a munition.

FIG. 4 shows the nose end 14 of the munition 10. A seal 26 is disposed in the fuze well 24. Seal 26 is also made of an ionomer. Seal 26 includes external threads that mate with the internal threads 34 of the fuze well. Fuze well seal 26 is preferably used in combination with the lifting plug seal 22. One or both of the lifting plug seal and the fuze well seal may be solid or hollow, as shown in FIGS. 3A and 3B.

In one embodiment, the munition 10 is provided with both a fuze well seal 26 and a lifting plug seal 22. Due to a fire or other event, the munition 10 is exposed to an exothermal source. As the casing 12 heats up, the explosive payload 28 absorbs thermal energy. The explosive 28 starts to expand and exert pressure on the fuze well seal 26. The increase in temperature causes the fuze well seal 26 to soften. As the pressure continues to increase, the fuze well seal 26 ruptures. The explosive 28 then forces its way into the fuze well 24.

As more thermal energy is imparted to the casing 12, the lifting plug seal 22 softens and the explosive 28 continues to expand. The increasing pressure causes the lifting plug seal 22 to rupture. The explosive 28 is then exposed to the atmosphere and vents the built up pressure in the casing 12. When exposed to the hot atmosphere, the explosive 28 will ignite in a controlled manner due to the limited size of the fuze well opening. The explosive 28 will start to burn and spew from the casing 12 until all the explosive has either been expelled or burned. In this way, the munition 10 releases its explosive energy in a way that is less destructive than a detonation. Both seals 22 and 26 will fail before the pressure and temperature in the casing 12 are great enough to detonate the explosive 28. It is believed that the seal 26 fails at about 115 degrees Centigrade and the seal 22 fails at about 125 degrees Centigrade, with a corresponding pressure of about 60 psi.

Figure 5:
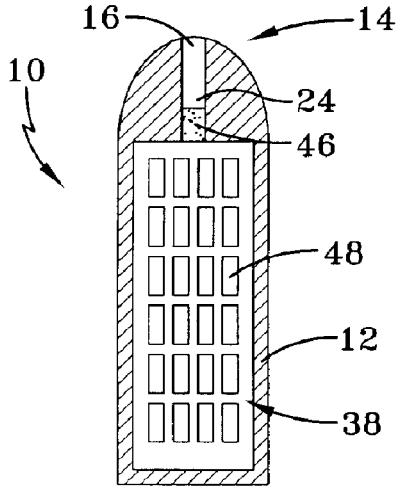
FIG-5 PRIOR ART
FIG. 5 is a sectional view of a munition.

FIG. 5 shows a munition 10 with an interior volume 38 loaded with dual purpose improved conventional munitions (DPICMs) 48, for example, grenades. The grenades 48 are expelled from the in-flight munition 10 using an expelling charge 46 located in the fuze well 24. The venting apparatus for this munition includes only the lifting plug 18 with seal 22. The fuze well seal 26 is not used.

Upon exposure to ambient heat, the casing 12 and fuze well 24 heat the expelling charge 46 and the seal 22. The seal 22 softens and the resultant increase in pressure from the expelling charge 46 will rupture the seal 22. The expelling charge 46 will burn off similar to explosive 28 described above. Without the expelling charge 46, the grenades 48 remain unarmed in the casing 12. Under continued heating, it is possible that one or more grenades 48 may explode. However, the grenades 48 remain in the casing 12, which helps to contain the explosion.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A munition, comprising:

a casing having a nose end and an opening in the nose end:

a lifting plug disposed in the opening in the nose end, the lifting plug including a bore therethrough, and a first seal disposed in the bore in the lifting plug, the first seal comprising an ionomer, and a fuze well disposed in the casing, the opening in the nose end leading into the fuze well; and a second seal disposed in the fuze well, said second seal comprising an ionomer, wherein at least one of the first seal and the second seal has a hollow interior.

* * * * *